United States Patent [19]

Starr

[11] 3,942,679

[45] Mar. 9, 1976

[54] SEALABLE CLOSURE ARRANGEMENT

[75] Inventor: Anthony J. Starr, Wilmington, Del.

[73] Assignee: Container Corporation of America, Chicago, Ill.

[22] Filed: Dec. 20, 1974

[21] Appl. No.: 534,707

[52] U.S. Cl. ..... 220/355; 150/.5; 220/306

[51] Int. Cl.[2] ..... B65D 43/06

[58] Field of Search ..... 220/319, 288, 355, 306, 220/320, 200, 378, 308, 357, 358, 72; 215/273, 274, 275, 317, 321; 150/.5

[56] References Cited

UNITED STATES PATENTS

| | | | |
|---|---|---|---|
| 3,189,072 | 6/1965 | Starr | 150/.5 |
| 3,610,306 | 10/1971 | Summers | 150/.5 |
| 3,664,544 | 5/1972 | Hammes | 220/308 |
| 3,792,797 | 2/1974 | Mrusek et al. | 220/319 |

*Primary Examiner*—William Price
*Assistant Examiner*—Steven M. Pollard
*Attorney, Agent, or Firm*—Carpenter & Ostis

[57] ABSTRACT

A sealable closure arrangement for a plastic container and full-removable-cover, including a container with a stiffening rim and a cover with a compliant skirt, which includes sealing, camming, and locking means for effecting such closure.

3 Claims, 6 Drawing Figures

SEALABLE CLOSURE ARRANGEMENT

BACKGROUND OF THE INVENTION

Field of the Invention

The invention relates to plastic containers with full-removable-cover which are required to have a sealable connection between the cover skirt and container rim.

SUMMARY OF THE INVENTION

It is an object of the invention to provide, in a closure arrangement for a plastic container with a stiffening rim and a full-removable-cover with a compliant skirt, means for properly aligning the cover on the container, means for effecting a sealing engagement between the cover and container, and means for locking the cover snugly on the container.

A more specific object of the invention is to provide, in an arrangement of the type described, a container rim having a deflectable sealing lip, an aligning groove, and a retaining ledge, all of which are adapted to cooperatively engage complementary portions of a cover skirt.

Another object of the invention is to provide, in a closure arrangement of the type described, a cover with a locking portion including a thin wall hinge section having integral depending camming and locking lugs adapted for engagement with the underside of a container rim ledge.

Yet another object is to provide, in an arrangement of the type described, a sealing ring which serves as an energy reservoir to effect tighter sealing between container and cover in the event the plastic material of the container and/or cover should lose some of its original resiliency.

These and other objects of the invention will be apparent from an examination of the following description and drawing.

THE DRAWING

THE SPECIFICATION

Figure 1:
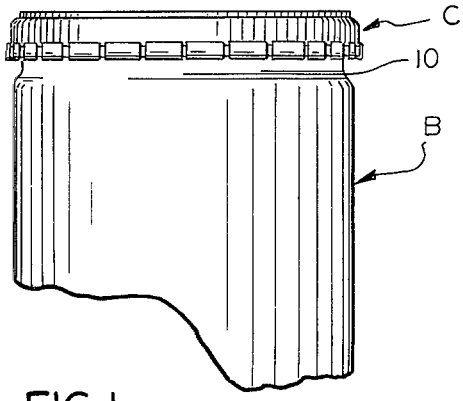
FIG. 1 is a side elevational view of a container and cover with a closure arrangement embodying features of the present invention.

Referring now to the drawing for a better understanding of the invention, it will be seen that the container, indicated generally at B in FIG. 1, is of the type known as a full-removable-head container having an outlet at the top with a diameter substantially equal to that of the container body. The Container B is provided with a removable and sealable cover indicated generally at C.

It will be seen that the container body has a neck 10 at its upper extremity which includes an outlet defined by an annular, integral rim 12.

Figure 5:
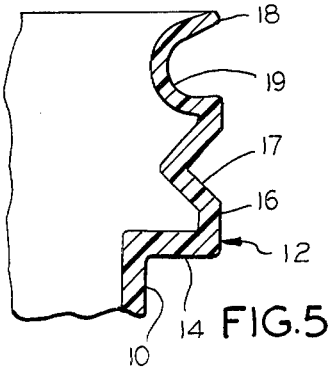
FIG. 5 is a fragmentary, vertical, sectional view of a portion of the container illustrated in FIG. 1, with the cover removed.

At its lower extremity rim 12 includes a horizontal ledge or shoulder 14 which projects outwardly from neck 10 for engagement with a locking portion 40 of cover C, in a manner hereinafter described. Rim 12 also includes a vertical center portion 16 extending upwardly from the outer periphery of ledge 14. As best seen in FIG. 5, vertical center portion 16 presents an annular, outwardly facing, generally V-shaped aligning groove 17 adapted to engage a complementary portion of the cover, in a manner hereinafter described. Additionally, rim 12 includes, at its upper extremity, a sealing portion 18 which curves inwardly and then outwardly and upwardly from the uppper extremity of vertical wall portion 16 to define an outwardly facing, annular, 180° groove, the purpose of which is described later in the specification.

Figure 2:
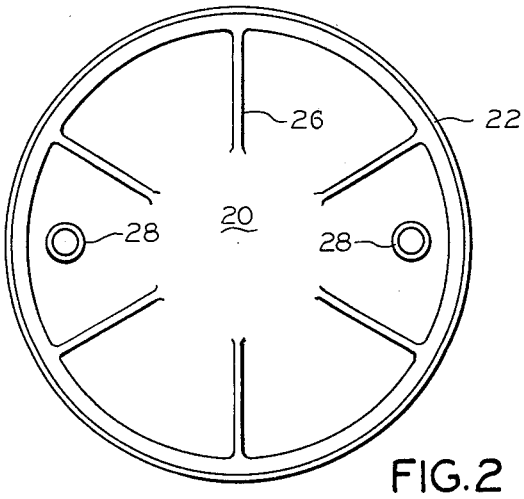
FIG. 2 is a plane view of the cover illustrated in FIG. 1.
Figure 3:
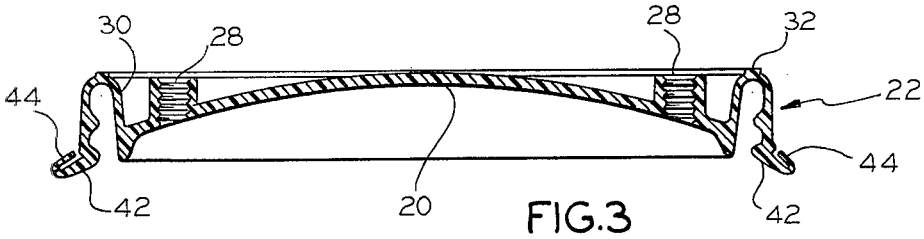
FIG. 3 is a transverse, vertical sectional view of the structure illustrated in FIG. 2.
Figure 4:
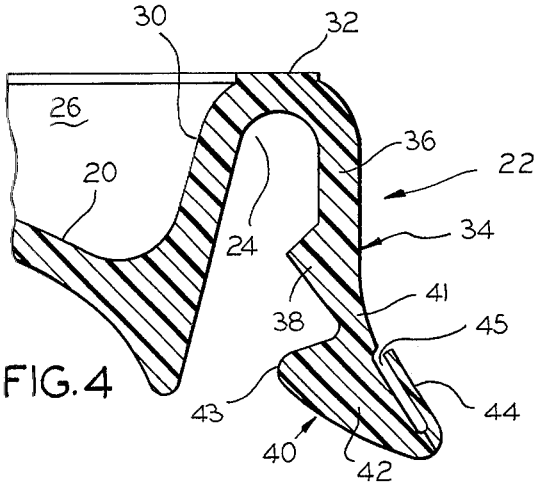
FIG. 4 is a view on an enlarged scale of an edge portion of the structure illustrated in FIG. 3.

As best seen in FIGS. 2 and 3, container cover C includes a round central portion, which is bowed upwardly to present a generally domed end 20, having depending from its outer periphery an annular skirt 22. As best seen in FIG. 4, the cross-section of skirt 22 is generally in the shape of an inverted "U" and defines an internal annular channel 24 adapted to receive rim 12 of the container body upon closure of the container by the cover. If desired, in order to reinforce the center section or domed end of the cover, there may be provided a plurality of reinforcing ribs or veins 26 which extend radially outward from the center portion of the cover to the rim. Although the container cover illustrated is a full-removable-cover, if desired it may be provided with one or more smaller openings 28 which are shown in FIGS. 2 and 3 of the drawing.

As best seen in FIG. 4, cover skirt 22 includes inner and outer walls 30 and 34 which are joined to each other at their upper ends by a curved, integral, top wall 32. Outer wall 34 includes a generally vertically disposed upper portion 36 which presents an annular inwardly extending, generally V-shaped, aligning bead 38 which is adapted to be received within complementary annular aligning groove 17 in the container body rim when the cover is placed on the container. The purpose of the aligning bead and groove is to assure proper alignment of the cover on the container, to insure that the sealing portion of the body rim will engage the cover properly and also that the camming and locking lugs of the cover locking portion will engage the container body rim locking ledge in a proper manner.

Figure 6:
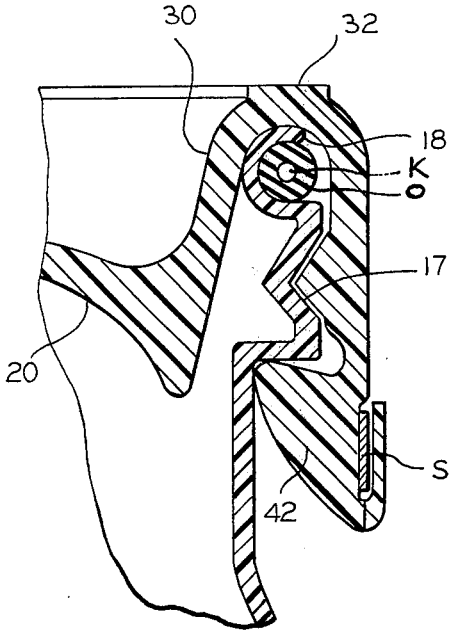
FIG. 6 is a sectional view illustrating the structures of FIGS. 4 and 5 in an assembled condition.

Still referring to FIG. 4, it will be seen that, at its lower extremity, outer wall 36 is provided with a locking portion, indicated generally at 40, which is integrally connected to upper wall portion 36 by an annular hinge portion 41. The cross sectional area of the hinge portion is thinner than that of the outer wall upper and locking portions so that it will afford a degree of flexibility when the cover is placed on the container. As best seen in FIGS. 4 and 6, locking portion 40 of the cover skirt includes a plurality of enlarged camming and locking lugs 42 which are formed integrally with hinge area 41 and which are spaced from each other circumferentially around the periphery of the skirt. Locking lugs 42 each present an inwardly facing, generally round, cam surface 43 adapted to help the cover skirt slip over the container rim when the cover is placed on the container body. After the cover has been placed on the container, lugs 42 engage the underside of rim locking ledge 14 to maintain the cover skirt in firm engagement with the body rim. In order to retain the lugs in tight engagement with the locking ledge, certain of the lugs may be provided with integral, outer, strap retaining elements, extending upwardly from the lower edges of the lugs adjacent the outer surfaces thereof and spaced a slight distance therefrom, which define an annular groove 45 for receiving conventional locking strap indicated generally at S. As the locking strap may be of a conventional design, it is not illustrated in specific detail.

Referring now to FIGS. 5 and 6, it will be seen that the upper extremity of the rim sealing section 18 is generally tapered so as to be more flexible. When the cover is placed firmly on the container, the upper portion of the sealing section is depressed or deflected downwardly to effect a snug sealing engagement between the rim and the cover. If desired, although not absolutely necessary, there may be provided an O-ring, indicated generally at O and having a wire core indicated generally at K, which is located within the annular groove 19 of the rim sealing portion.

As previously stated, the container and cover will have a sealing engagement without the use of the ring O. However, it has been found that as time goes by if the plastic material of the cover or rim loses some of its resiliency or elasticity, the O-ring may serve as an "energy reservoir" to provide an additional force to effect the proper sealing between the container rim and the cover skirt.

I claim:

1. In a sealable closure arrangement for a plastic container body and a full-removable-cover, the combination of:

a. a unitary, tubular body having an open upper end terminating in an annular stiffening rim;

b. said rim comprising:

i. a peripheral, horizontal, retaining ledge portion extending radially outward from said body;

ii. a vertical center portion extending upwardly from the outer periphery of said ledge portion and presenting thereon an outwardly facing, V-shaped aligning groove;

iii. a sealing portion curving inwardly from the upper extremity of said center portion and then curving outwardly and upwardly to present therein a generally semicircular groove;

c. a cover having a round central portion with a peripheral, dependent, annular, compliant skirt adapted for sealing engagement with said rim;

d. said skirt comprising inner and outer walls joined by a curved upper wall to form a channel for receiving said rim, said outer wall including:

i. a vertical upper portion presenting an inwardly projecting V-shaped aligning bead adapted to be received within the V-shaped aligning groove of said rim for properly positioning said cover on said body;

ii. a locking portion joined to the lower extremity of said upper portion by a relatively flexible hinge portion having a cross-sectional area which is of less thickness than that of the locking and upper portions;

iii. said locking portion including at least one cover camming and retaining lug adapted for engagement with the underside of the retaining ledge portion of said rim;

e. said skirt upper portion being adapted to engage and compress said rim sealing portion to effect a snug sealing engagement between said rim and skirt;

f. means engageable with said cover locking portion for exerting a radial force thereagainst to retain said cover firmly on said container.

2. In a sealable closure arrangement for a plastic container body and a full-removable-cover, the combination of:

a. a unitary, tubular body having an open upper end terminating in an annular stiffening rim;

b. said rim comprising:

i. a peripheral, horizontal, retaining ledge portion extending radially outward from said body;

ii. a vertical center portion extending upwardly from the outer periphery of said ledge portion and presenting therein an outwardly facing, V-shaped aligning groove;

iii. a sealing portion curving inwardly from the upper extremity of said vertical center portion and then curving outwardly and upwardly to present therein a generally semicircular groove;

c. a cover having a round central portion with a peripheral, dependent, annular, compliant skirt, adapted for sealing engagement with said rim;

d. said skirt comprising inner and outer walls joined by a curved upper wall to form a channel for receiving said rim, said outer wall including:

i. a vertical upper portion presenting an inwardly projecting V-shaped aligning bead adapted to be received within the V-shaped aligning groove of said rim for properly positioning said cover on said body;

ii. a locking portion joined to the lower extremity of said upper portion by a relatively flexible hinge portion having a cross-sectional area which is of less thickness than that of the locking and upper portions;

iii. said locking portion including at least one cover camming and retaining lug adapted for engagement with the underside of the retaining ledge portion of said rim;

e. means engageable with said cover locking portion for exerting a radial force thereagainst to retain said cover firmly on said container.

3. In a sealable closure arrangement for a plastic container body and a full-removable-cover, the combination of:

a. unitary, tubular body having an open upper end terminating in an annular stiffening rim;

b. said rim comprising:

i. a peripheral, horizontal, retaining ledge portion extending radially outward from said body;

ii. a vertical center portion extending upwardly from the outer periphery of said ledge portion and presenting therein an outwardly facing, V-shaped aligning groove;

c. a cover having a round central portion with a peripheral, dependent, annular, compliant skirt, adapted for sealing engagement with said rim;

d. said skirt comprising inner and outer walls joined by a curved upper wall to form a channel for receiving said rim, said wall including:

i. upper portion presenting an inwardly projecting V-shaped aligning bead adapted to be received within the V-shaped aligning groove of said rim for properly positioning said cover on said body;

ii. a locking portion joined to the lower extremity of said upper portion;

iii. said locking portion including at least one cover camming and retaining lug adapted for engagement with the underside of the retaining ledge portion of said rim;

e. means engageable with said cover locking portion for exerting a radial force thereagainst to retain said cover firmly on said container.

* * * * *